United States Patent [19]

Stern et al.

[11] 4,424,517

[45] Jan. 3, 1984

[54] INTEGRATED DIELECTRIC WAVEGUIDE RADAR FRONT END DEVICE

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 499,735

[22] Filed: May 31, 1983

[51] Int. Cl.[3] ..... H01Q 13/10

[52] U.S. Cl. ..... 343/771; 333/1.1

[58] Field of Search ..... 333/1.1; 343/771, 767, 343/769

[56] References Cited

U.S. PATENT DOCUMENTS

| | | | |
|---|---|---|---|
| 2,850,705 | 9/1958 | Chait et al. | 333/1.1 |
| 2,946,997 | 7/1960 | Honer | 343/771 |
| 3,094,664 | 6/1963 | Kibler | 343/785 |
| 3,467,918 | 9/1969 | Dunn et al. | 333/1.1 |
| 3,761,924 | 9/1973 | McGowan | 333/1.1 |

*Primary Examiner*—Maynard R. Wilbur
*Assistant Examiner*—M. R. Gordon
*Attorney, Agent, or Firm*—Robert P. Gibson; Jeremiah G. Murray; Edward Goldberg

[57] ABSTRACT

A monolithic waveguide radar front end subsystem utilizing dielectric components. The use of dielectric waveguide transmission elements permits conformal mounting while exhibiting operating characteristics comparable to those of conventional metal waveguide subsystems.

8 Claims, 3 Drawing Figures

INTEGRATED DIELECTRIC WAVEGUIDE RADAR FRONT END DEVICE

STATEMENT OF GOVERNMENT INTEREST

The invention described herein may be manufactured, used and licensed by or for the Government for Governmental purposes without the payment to us of any royalties thereon or therefor.

BACKGROUND OF THE INVENTION

This invention relates generally to radar antenna subsystems and, more particularly, to dielectric waveguide control devices for millimeter wave radar applications. Numerous forms of dielectric waveguide component design have been developed and utilized over the past several years. However, the lack of ferrite control devices has been a major obstacle in creating fully integrated dielectric waveguide subsystems, thereby limiting the usefulness of such dielectric components. With the optimization of a dielectric waveguide capable of propagating a $TE_{10}$ mode, such as magnesium titanate, the translation of conventional metal waveguide ferrite device designs into equivalent dielectric waveguide counterparts is now possible. Similar dielectric components which are relevant to the present invention include an isolator as disclosed in U.S. Patent Application Ser. No. 387,987, filed June 14, 1982, a waveguide circulator as shown in U.S. Patent application Ser. No. 310,542, filed Oct. 13, 1981, and a frequency scan antenna as set forth in U.S. Patent Application Ser. No. 409,201 filed Aug. 18, 1982. These, components may be combined with dielectric waveguide antennas to produce integrated radar subsystems having operating characteristics rivaling that of conventional metal waveguide devices.

SUMMARY OF THE INVENTION

The object of this invention is to provide a monolithic radar antenna front end subsystem capable of being fully integrated in a dielectric waveguide transmission line. A further object of this invention is to provide a millimeter wave doppler radar front end which is smaller and less complex than the conventional metal waveguide systems, and which lends itself to conformal mounting while exhibiting presently-available radar front end units.

The integrated radar front end system according to the present invention utilizes a standard dielectric transmission line to provide an isolator and an antenna which is combined with a non-reciprocal ferrite circulator thereby allowing the antenna to be used for both transmission and reception.

The radar front end device, as presently described, was first publicly presented at the Intermag-Magnetism and Magnetic Materials Conference in July, 1982. The report of the proceedings of this conference is herein incorporated by reference. ("Dielectric Waveguide Ferrite Devices and Applications," R. A. Stern and R. W. Babbitt).

DESCRIPTION OF A PREFERRED EMBODIMENT

Figure 1:
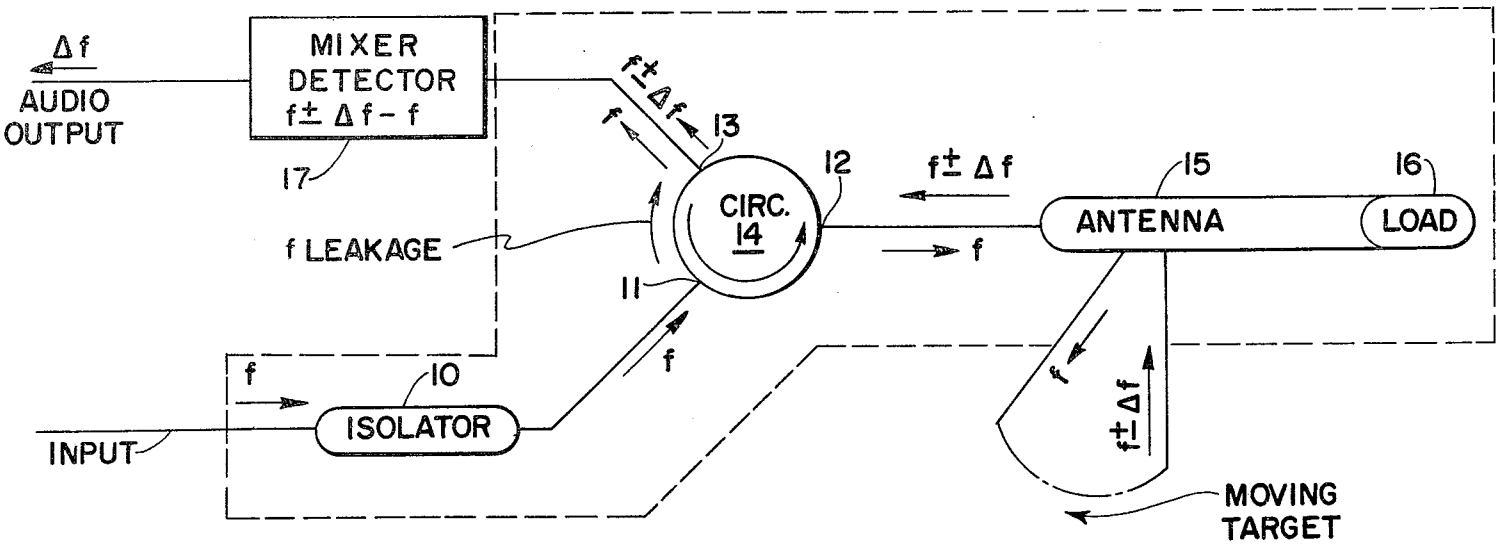
FIG. 1 is a equivalent circuit block diagram of the radar front end of the present invention illustrating the operation of the device.

Referring to FIG. 1, the block diagram equivalent circuit illustrates the operation of the subject invention. An input signal frequency, f, is injected into the circuit and transmitted through isolator 10. The isolator 10 has the characteristic of having a low insertion loss in the forward direction while presenting a high loss in the reverse direction, thus providing protection to the signal source from undersirable return signals. The signal, f, enters circulator 14 at port 11 and is transmitted with low loss to port 12 which is coupled to antenna 15 and load 16. Antenna 15 radiates a narrow beam pattern which, upon encountering a moving target, produces a reflected signal back to antenna 15 at a return frequency, $f \pm \Delta f$, with the change in frequency being a doppler shift due to the movement of the target. The new frequency signal re-enters circulator 14 at port 12, is transmitted through the circulator, and emerges at port 13. The input signal at port 11 also provides a reverse-direction, low-level leakage of the signal, f, to circulator port 13. The combination of the new frequency signal, f, is transmitted from port 13 to a receiving apparatus, mixer detector 17, where the signals are mixed to yield $\Delta f$ which can be detected at audio levels. Thus, an audio response results when a moving target is encountered.

Figure 2:
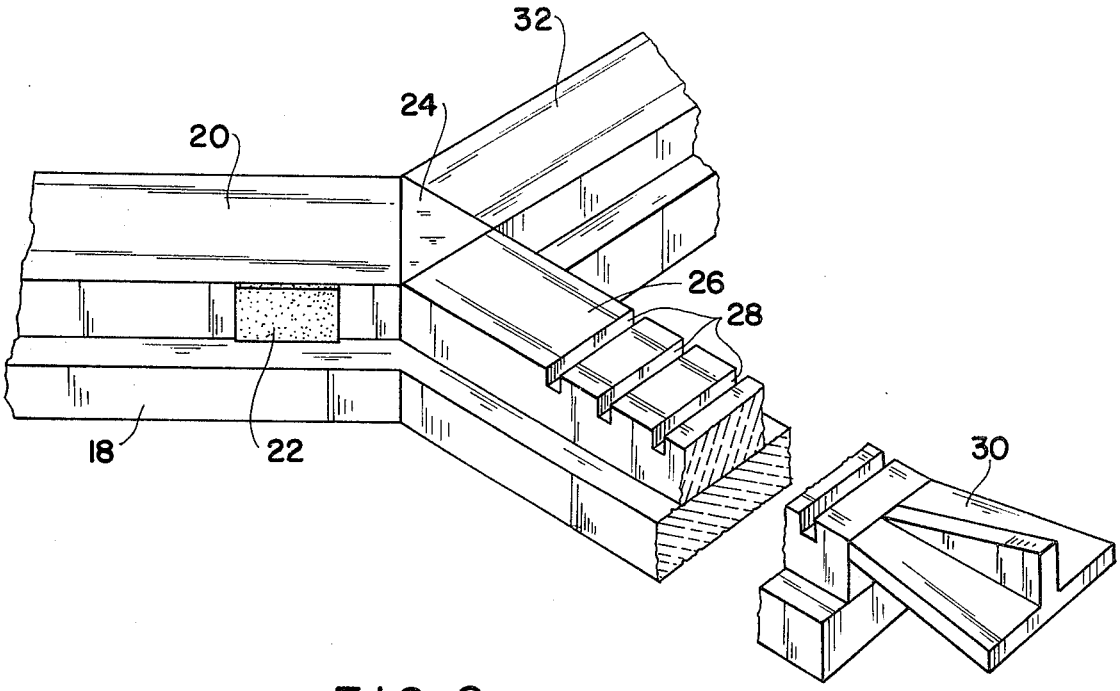
FIG. 2 is a schematic representation of a Y-junction dielectric radar front end device constructed in accordance with the invention.

Referring to FIG. 2, a radar front end assembly utilizing dielectric waveguide control components in accordance with the invention is shown having three sections of dielectric waveguide comprising an input section 20, an antenna radiating section 26, and an output waveguide section 32 connected to three separate ports of a circulator 24. The entire assembly is shown mounted on dielectric support 18 having a low dielectric constant ($\epsilon = 2$ to 4).

The input section 20 includes section of dielectric waveguide ($\epsilon = 12$ to 16) having an isolator 22 affixed to one sidewall. The isolator 22 is typically in the form of a thin (0.005") rectangular substrate of NiCo hexagonal ferrite material which, after being bonded to the waveguide by conventional means, is placed between the pole pieces of an electromagnet in order to fully orient the ferrite material.

The antenna radiating section 26 consists of a dielectric waveguide shown mounted on a dielectric support 18 having substantially identical composition and cross-sectional dimensions as input section 20. Periodically spaced, transverse slots 28 in the top of the dielectric waveguide cause this slotted portion to function as an antenna. That is, a traveling wave of millimeter wavelength is propagated in the antenna radiating dielectric waveguide, the wave is perturbed by slots 28 giving rise to radiation from the antenna section 26. Load 30 prevents the reflection back to the waveguide of any traveling wave energy which has not been radiated by the antenna by absorbing it.

The output waveguide section 32 consists simply of a section of dielectric waveguide connected to the final output port of the circulator for receiving the output signal. The output section 32 may be connected to any means for detecting frequency such as the mixer detector 17 shown in FIG. 1.

As shown in FIG. 2, a Y-junction circulator 24 comprises a triangular prism having two bases which are equilateral triangles separated by an axial length (or the perpendicular distance between the two bases) which is longer than the sides of the triangle bases. The circulator 24 is fully integrated in the front end subsystem such that the rectangular lateral faces of the prism, at right angles to the triangular bases are fully covered by the cross-section faces of dielectric waveguide sections 20, 26 and 32. These waveguide ends are bonded to the prism faces in a conventional manner using a low-loss adhesive such as an epoxy compound. A magnetic bias applied along the axial length between the two bases of the circulator provides the required degree of magnetization within the prism. In practice, this may be accomplished by bonding a permanent magnet in conjunction with a dielectric spacer to the upper and lower bases of the prism.

In a preferred embodiment, the dielectric constant of the circulator should match, as closely as possible, that of the dielectric waveguides in order to minimize impedance discontinuities and mismatches at the circulator port junctions. In practice, it has been found that dielectric waveguide composed of magnesium titanate having a dielectric constant ($\epsilon$) of approximately 16 have been satisfactorily matched with circulators of either lithium ferrite ($\epsilon = 15\frac{1}{2}$ to 16) or nickel-zinc ferrite ($\epsilon = 13$).

Figure 3:
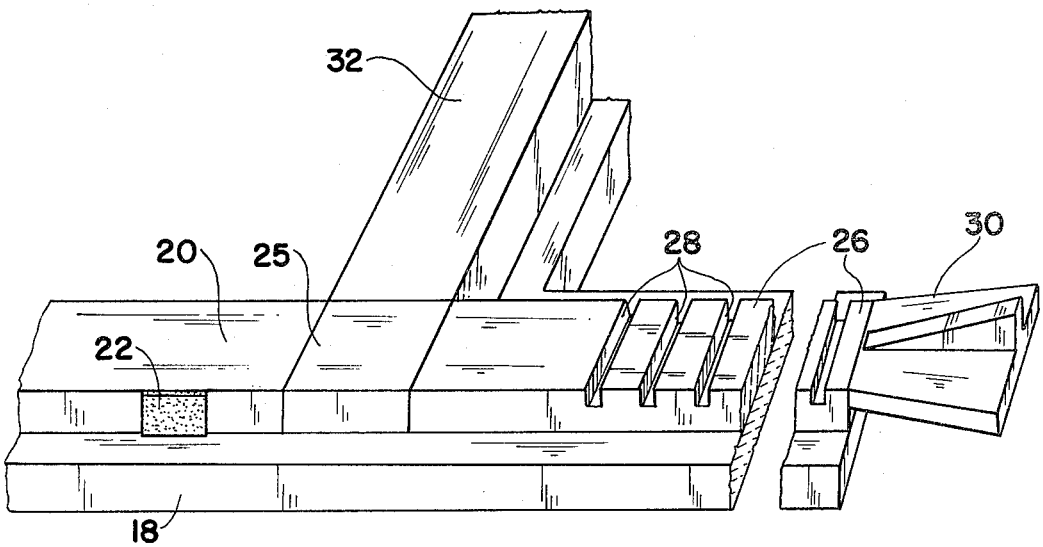
FIG. 3 is a schematic representation of a modification of the present invention utilizing a T-junction configuration.

Referring now to FIG. 3, a second embodiment is shown having a T-junction configuration replacing the Y-junction of FIG. 2. Here, the T-junction circulator 25 is a ferrimagnetic element in the form of a right prism having square bases and an axial length between the bases greater than the sides of the square. This results in four rectangular lateral faces having the sides of the square bases as their short sides. As shown, three of the four lateral faces have dielectric waveguide sections 20,26 and 32 attached thereto, bonded in the manner described previously for the Y-junction circulator. Likewise, the magnetic bias may be applied between the bases in the same manner as that described for the Y-junction configuration.

While the T-junction circulator might be advantageous for certain applications, because of its shape, the lack of symmetry around the three-port axis could result in undersirable characteristics in other applications.

This integrated dielectric waveguide circuit, being fabricated in this type of transmission line utilizing dielectric waveguide control components, offers the advantage of being significantly smaller and more lightweight than conventional metal waveguide circuits while performing the same functions. In practice, the circuit constructed in accordance with in FIG. 2 was found to exhibit a 4° antenna beamwidth which could be scanned over a 45° sector in the search and detection of reflective moving targets. Further, the circuit allows for more cost-effective fabrication because of the elimination of the need for metallization and the fact that the dielectric waveguides lend themselves to conformal mounting.

While the invention has been described in connection with preferred embodiments, obvious variations therein will occur to those skilled in the art without departing from the teachings of the invention. Accordingly, the invention should be limited only by the scope of the appended claims.

What is claimed is:

1. A monolithic dielectric waveguide radar front end device comprising;

a dielectric transmission line having an input section and an antenna radiating section;

a non-reciprocal prism shaped ferrite circulator integrated in said transmission line and interposed between said input section and said antenna radiating section, said circulator having opposing base surfaces and three lateral rectangular faces providing three ports, said input section being connected to one face, said antenna section being connected to a second face; and a dielectric waveguide output section connected to the third face for coupling energy out of said circulator.

2. A radar front end device as set forth in claim 1 wherein:

said input section of said transmission line includes an isolator.

3. A radar front end device as set forth in claim 2 wherein:

said isolator comprises a ferrite substrate affixed to a side of said dielectric transmission line.

4. A radar front end device as set forth in claim 3 wherein:

said dielectric transmission line, said circulator, and said output section have substantially equal dielectric constants.

5. A radar end device as set forth in claim 4 wherein:

said antenna radiating section comprises a plurality of periodically spaced transverse slots in one surface of said transmission line.

6. The device of claim 5 including load means connected to the end of said antenna section.

7. The device of claim 4 wherein said prism shaped circulator is triangular providing a Y-junction for said sections.

8. The device of claim 4 wherein said prism shaped circulator is a right prism having four faces providing a T-junction for said sections.

* * * * *